United States Patent [19]

d'Argembeau

[11] Patent Number: 4,542,552

[45] Date of Patent: Sep. 24, 1985

[54] TOOTHBRUSHES

[76] Inventor: Etienne Y. d'Argembeau, Rue de Belle-Vue, 24, B-1050 Bruxelles, Belgium

[21] Appl. No.: 580,999

[22] Filed: Feb. 16, 1984

[30] Foreign Application Priority Data

Feb. 21, 1983 [BE] Belgium ..... 210,156
Jan. 20, 1984 [BE] Belgium ..... 212,243

[51] Int. Cl.[4] ..... A46B 9/04

[52] U.S. Cl. ..... 15/167 R; 15/110; 15/143 R; D4/104

[58] Field of Search ..... 15/167 R, 110, 143 R; D4/104–106

[56] References Cited

U.S. PATENT DOCUMENTS

| | | | |
|---|---|---|---|
| 876,185 | 1/1908 | Hillman | 15/167 R |
| 2,304,319 | 12/1942 | Saltzman | 15/167 R |
| 3,295,156 | 1/1967 | Brant | 15/167 R |
| 3,754,295 | 8/1973 | Hyman | 15/167 R |
| 4,127,113 | 11/1978 | Nollan | 15/201 X |

FOREIGN PATENT DOCUMENTS

| | | | |
|---|---|---|---|
| 569971 | 4/1924 | France | 15/167 R |
| 659139 | 1/1929 | France | 15/167 R |
| 520043 | 3/1955 | Italy | 15/167 R |

*Primary Examiner*—Peter Feldman
*Attorney, Agent, or Firm*—Sughrue, Mion, Zinn, Macpeak and Seas

[57] ABSTRACT

This invention relates to a toothbrush, the head of which preferably has a circular or elliptical cross section and carries at least one tuft of bristles, the width of which substantially corresponds to the depth of the sulcular sulcus.

The head of the brush is preferably joined to a handle which has a polygonal cross section, preferably a square cross section, the median longitudinal plane of the tuft of bristles advantageously forming an angle of less than 90°, preferably an angle of 45°, with the plane of at least one surface of the handle having a polygonal cross section, which surface is turned towards the free end of the tuft of bristles.

6 Claims, 8 Drawing Figures

TOOTHBRUSHES

PRIOR ART

Known toothbrushes generally have a head mounted at the end of a handle. The profile of the head is flat or convex and it has a number of tufts of bristles on one of the surfaces thereof. The head of known brushes is generally from 20 to 30 millimetres long, from 10 to 12 millimetres wide and from 4 to 5 millimetres thick. The free end of the head is often rounded to prevent the soft tissue of the buccal cavity from being irritated.

In most of the known toothbrushes, the bristles are grouped together to form tufts which are inserted into cavities made in the head. The bristles are often made of nylon and they may vary in diameter up to 0.28 millimetres.

OBJECTS OF THE INVENTION

An object of the present invention is to provide a toothbrush which is designed so that it may be used under conditions such that it not only allows the bacterial plaque which covers the surface of the teeth to be removed, but is also allows the non-keratinized sulcular gum and the junction epithelium to be massaged.

Clinical and histological studies have shown that parodontopathies, such as gingivitis do not appear at that part of the gum which is keratinized, but at the non-kerathinized gingival sulcus.

Another object of the present invention is to provide a toothbrush which allows the bacterial plaque to be removed from the complete surface (masticating and non-masticating) of the teeth, including the surface at the sulcular gum and the interdental surface, and which also allows the sulcular gum to be brushed and massaged, ensuring keratinization thereof.

A further object of the present invention is to provide a toothbrush which differs from conventional toothbrushes as much by the dimensions and the shape of the tufts of bristles as by the shape and dimensions of the head carrying these tufts of bristles, and also by the shapes and dimensions of the handle to which the head is connected. These differences make it possible to obtain a toothbrush which provides the advantages mentioned in the preceding paragraph, due to a method of use which differs radically from that of conventional toothbrushes, as will be described later on.

BRIEF DESCRIPTION OF THE INVENTION

The toothbrush according to the present invention which has a head provided with at least one tuft of individual bristles which are tangential to each other is essentially characterized in that the width of the tuft or tufts substantially corresponds to the depth of the sulcular sulcus. In practice, this width is from about 0.5 to 3 millimetres.

According to one characteristic of the toothbrush of this invention, the head from which at least one tuft of bristles projects, has a constant circular or elliptical cross section, the diameter of which is from about 3 to 5 mm, the length of the head preferably being greater than that of the rows of premolar and molar teeth.

According to another characteristic of this invention, the head of the toothbrush is connected to a handle of a polygonal cross section, while the median longitudinal plane of the tuft or tufts of bristles preferably forms an angle of less than 90° with the plane of at least one surface of the handle having a polygonal cross section, turned towards the free end of the tuft or tufts of bristles, said angle preferably amounting to 45°.

In one particular embodiment of the toothbrush according to the present invention, the median longitudinal plane of the tuft or tufts of bristles is a bisecting plane with respect to the planes of two symetrical surfaces of the handle having a polygonal cross section, turned towards the free end of the tuft or tufts of bristles.

On account of the characteristic shapes and dimensions of the parts of the toothbrush according to this invention, this toothbrush may be used in a completely different manner compared to that of conventional toothbrushes.

When conventional toothbrushes are used, the teeth are brushed by means of the free ends of the bristles according to an alternating action.

This method of using conventional toothbrushes prevents one from reaching certain difficulty accessible surfaces such that the bacterial plaque is not effectively removed therefrom and the appearance of recurring parodontopathies is not adequately prevented. Moreover, the design and the method of use of conventional toothbrushes allows only a mediocre and irregular penetration of the bristles into the gingival sulcus so that the removal of bacterial plaque and the disappearance of parodontopathies in the sulcus are not ensured.

The toothbrush according to the present invention is outstandingly suitable for use according to an original method which allows the ends of the bristles to penetrate right down to the bottom of the sulcular sulcus, between the gingival crest and the teeth, in order to ensure a gentle massaging of the internal surface of the gingival gum and to promote the homogeneous appearance of a protective keratinization of this surface. Moreover, the tangential bristles of the toothbrush according to this invention are used to scrape the lateral surface of the teeth by their lateral surfaces, rather than brushing the lateral surface of the teeth with their ends.

DETAILED DESCRIPTION OF THE INVENTION

Other characteristics and details of the present invention will be revealed from the following description of the accompanying drawings which schematically show two embodiments of a toothbrush according to the present invention, and the method of using this toothbrush.

In these different Figures, the same reference numerals denote identical elements.

Figure 2:
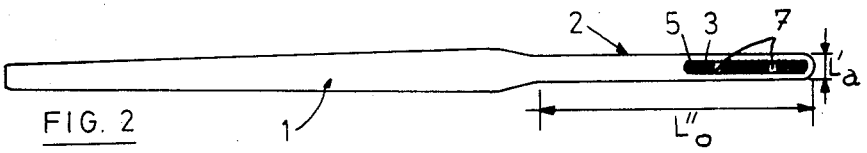
FIG. 2 is an elevational view showing the toothbrush according to the present invention, seen from behind.
Figure 3:
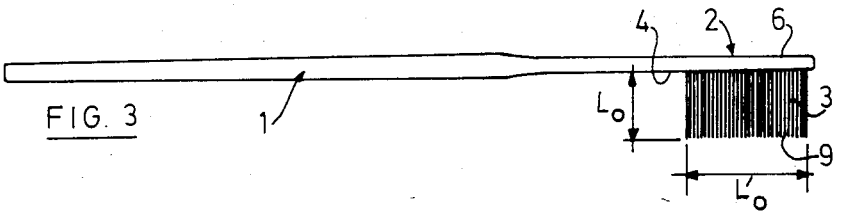
FIG. 3 is a lateral elevational view of the toothbrush shown in FIG. 1.
Figure 1:
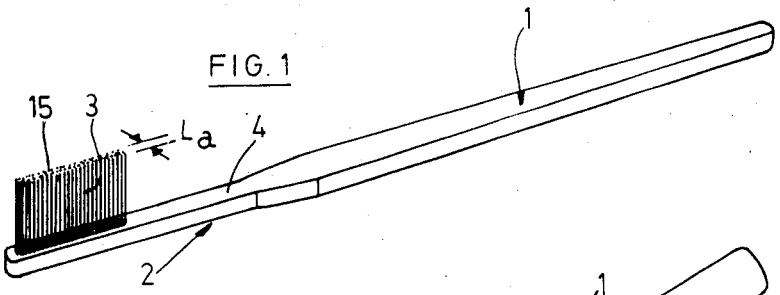
FIG. 1 is a perspective view of a first embodiment of a toothbrush according to the present invention.

The toothbrush according to the present invention which is shown in FIGS. 1 to 3 of the drawings comprises a handle 1 which is terminated by a head 2 carrying a large number of bristles 3 which are perpendicular to a surface 4 of the head 2 and are tangential to one another.

Instead of reaching into the extension of the head 2 as shown in FIGS. 2 and 3, the handle 1 of the toothbrush may be inclined or curved so that the head 2 carrying the bristles 3 is at a lower level than that of the handle or a part thereof when the toothbrush is placed on a surface with its bristles pointing upwards. This position promotes the access of the bristles to the teeth, in particular from the lingual side of the dental crown.

The tuft or bristles 3 may consist of, for example 1,200 bristles or rigid monofilament fibres made, for example of nylon, having a diameter of 0.22 millimetres and forming a dense tuft, the width $L_a$ of which substantially corresponds to the depth of the sucular sulcus, this depth being about 0.5 to 3 millimetres.

The bristles are preferably all the same length and they project from the surface 4 of the head 2 over a distance which is at least equal to the average maximum height of the teeth, that is, in practice a length $L_o$ of from 10 to 15 millimetres. The free ends of the bristles form a level surface, but this surface may also be slightly convex or concave. The surface which is formed by the free ends of bristles is dense and is free of projecting bristles and unevennesses. The length $L'_o$ of the tuft of bristles 3 is not critical. For example, it may vary between 15 and 25 millimetres.

The tuft of bristles 3 is inserted into an opening 5 which is provided with reinforcing bars 7 and is made through the head 2 from the surface 4 of the head to its opposite surface 6. This surface 6 reveals the ends of the bristles which are soldered together and have hundreds of capillary passages.

The free ends of the individual bristles are preferably rounded, like a mushroom head.

The head 2 of the toothbrush advantageously has a width $L'_a$ of about 3 millimetres and a thickness of from about 2 to 3 millimetres, the length $L''_o$ of this head ranging from 30 to 60 millimetres.

Figure 4:
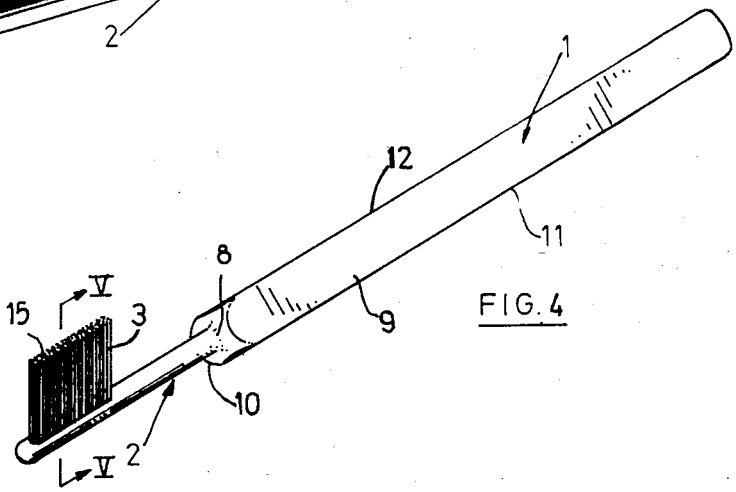
FIG. 4 is a perspective view of a second embodiment of a toothbrush according to the present invention.
Figure 5:
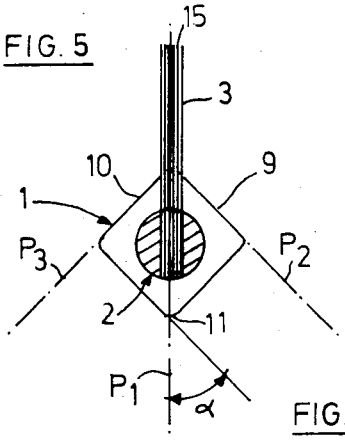
FIG. 5 shows a cross section, on a larger scale, along line V—V of FIG. 4.

The second embodiment of the toothbrush according to the present invention which is shown in FIGS. 4 and 5 differs from the embodiment shown in FIGS. 1 to 3 in that the head 2 has a circular cross section over its complete length, and it is joined at reference numeral 8 to a handle 1 having a polygonal cross section. The diameter of the head 2 is preferably from about 3 to 5 millimetres.

Instead of having a circular cross section, the head 2 may have a elliptical cross section.

The handle 1 in FIGS. 4 and 5 has a square cross section.

The median longitudinal plane, which is indicated by the chain-dotted line $P_1$ in FIG. 5, of the tuft of bristles 3 forms an angle of less than 90°, preferably an angle of 45° with the plane $P_2$ of at least one surface of the handle which is turned towards the free end of the tuft of bristles 3. As may be seen from FIG. 5, the plane $P_1$ is a bisecting plane which forms an angle $\alpha$ of 45° with the planes $P_2$, $P_3$ of two symmetrical surfaces 9 and 10 of the handle 1 having a square cross section, which are turned towards the free end of the tuft of bristles 3. Moreover, the plane $P_1$ contains opposite edges 11 and 12 of the handle 1.

As a result of the above-mentioned angle $\alpha$ between the planes $P_2$, $P_3$ of the surfaces 9 and 10 of the handle 1 and the median longitudinal plane $P_1$ of the tuft of bristles 3, the user has a reliable means for suitably orienting the tuft of bristles 3 when he picks up the toothbrush. Thus, if the user is right-handed and if he wishes to brush his lower teeth, he puts the thumb of his right hand onto the surface 10, whereas if he is left-handed, he puts the thumb of his left hand on the surface 9 of the handle. When the handle 1 is held in the right hand in this way, the tuft of bristles 3 is oriented in such a way that the brush may be used according to the method which is described later on and which is quite different from the conventional method or methods of use of known toothbrushes.

The dimensions of the head 2 and of the tuft of bristles 3 of the compact sulcular brush according to the present invention are much smaller than those of conventional brushes.

On account of the design and the dimensions of the head 2 of the tuft of bristles 3 and of the handle 1, the toothbrush according to this invention, in particular the brush shown in FIGS. 4 and 5 may be used according to a method which makes it possible to dislodge the bacterial plaque and the cells which have flaked off from the junction and sulcular gums, while at the same time making it possible to scrape the vestibular and lingual surfaces of the teeth.

Figure 6:
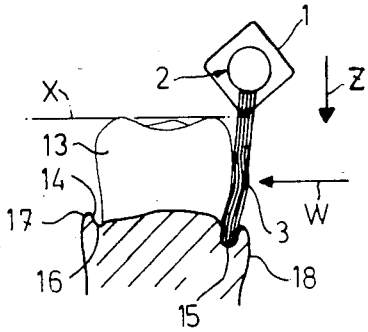
FIG. 6 is an elevational view showing a toothbrush according to the present invention positioned against a tooth.
Figure 7:
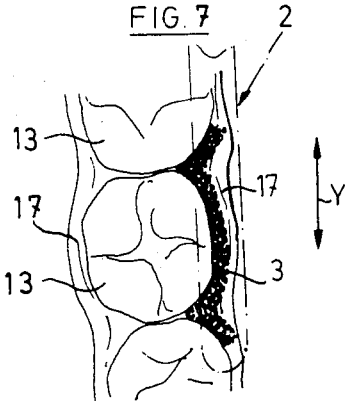
FIG. 7 is a plan view in the direction of the arrow Z in FIG. 6.
Figure 8:
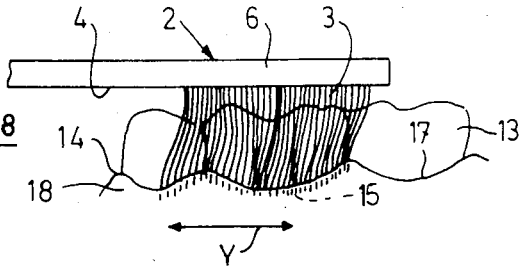
FIG. 8 is an elevational view in the direction of the arrow W in FIG. 6.

The method of using the toothbrush according to the present invention is shown in FIGS. 6 to 8.

As may be seen from FIG. 6, the brush is positioned so that its bristles 3 extend parallel to the vestibular or lingual surface of the dental crown, i.e., so that the free ends of the bristles are tangential to the lateral surface of the teeth 13 at the shoulder 14. Due to the reduced width (from 0.5 to 3 millimetres) of the tuft of bristles 3, the free ends 15 of the bristles penetrate the sulcular sulcus 16 between the gingival crest 17 and the teeth 13. While the free ends 15 of the bristles are in contact with the bottom of the sulcular sulcus, the lateral surface of the bristles is applied to the lateral vestibular or lingual surface of the dental crown, while assuming the winding shape of this crown, as shown in FIG. 7. When the head 2 and the tuft of bristles 3 are in the position shown in FIGS. 6 and 7 in which the head 2 is parallel to the occlusal plane X, pressure is exerted on the head 2 towards the centre of the teeth. In this manner, the bristles 3 are positioned regularly over the complete length of the gingival sulcus 16, following the periphery of the shoulder 14 of the teeth 13 up to the interdental space. The head 2 of the brush is then subjected to a low amplitude vibratory backwards and forwards movement in the direction of the arrows Y so that the free ends 15 of the bristles 3 embedded in the gingival sulcus 16 ensure a massage and a scraping of the inside of this gingival sulcus 16, while the bristles 3 move over the lateral vestibular or lingual surface of the dental crown with their lateral surfaces.

FIG. 8 shows the winding movement made by the bristles 3 while scraping the coronary surface of the teeth with their lateral surfaces, while the free ends 15 of the bristles massage the gingival sulcus 16.

Thus, it is seen that instead of being directed towards the lateral surface of the teeth, the bristles 3 of the brush according to the present invention extend parallel to this lateral surface. The free ends 15 of the bristles 3 embedded in the gingival sulcus 16 undergo almost no displacement in this sulcus and simply massage the gingival and papillary sulcus. As a result of this massage and due to the capillarity effect produced by the bristles which are tangential to one another, there results an aspiration of the bacterial plaque from the inside of the gingival sulcus 16 towards the back surface of the head 2 of the brush, while the surface of the crown and of the shoulder of the teeth 13 is cleaned by the lateral surface of the bristles which pass over this surface.

The above-described method of using the toothbrush according to the present invention allows a complete removal of the bacterial plaque contained in the gingival sulcus, and a cleaning of the coronary surface and of the shoulder of the teeth without a gingival irritation, without the risk of scratching or wearing away the coronary surface and the shoulder of the teeth and without a pressure being exerted by the keratinized part of the gum on the tooth (which eliminates any risk of gingival recession). The massaging of the internal surface of the gingival sulcus by the free ends 15 of the bristles 3 promotes a homogeneous keratinization which ensures a protection of the cellular layer of this internal surface.

The shape and the dimensions of the head 2 of the compact sulcular brush according to the present invention make it virtually impossible to brush the teeth in such a way which is likely to cause gingival lesions and other lesions in the user's mouth.

Instead of having a single tuft of bristles which is substantially parallelepipedal in shape, the toothbrush may have two tufts which are at a distance from one another, or may have more than two tufts in the longitudinal direction of the head 2.

Instead of having a square cross section, the handle 1 of the brush may have a cross section of any regular polygonal shape, for example in the shape of an equilateral triangle, a regular pentagon, a regular hexagon etc.

What I claim is:

1. A toothbrush, comprising:

(a) a handle (1) having a constant polygonal cross-section;

(b) a head (2) having a circular or elliptical cross-section, the width or diameter of which is smaller than the width of the handle; and (c) a single elongated tuft of bristles (3) carried by said head, said bristles having the same length, being substantially tangent to each other, and extending perpendicular to a plane comprising two opposite edges of the polygonal handle.

2. A toothbrush according to claim 1, in which the single tuft of bristles has the shape of an elongated parallelipiped having a rectangular cross-section and said bristles are fixed by one of their ends in an elongated opening (5) of the head, wherein said ends are soldered together and to the edge of the opening so as to form between them a multiplicity of capillary passages.

3. A toothbrush according to claim 2, in which said ends of the tuft of bristles are flush with a surface of the head which is opposite to a surface of the head from which the bristles protrude.

4. A toothbrush according to claim 1, in which the width of the tuft substantially corresponds to the depth of the gingival sulcus.

5. A toothbrush according to claim 1, in which the handle has a constant square cross-section.

6. A toothbrush according to claim 1, in which the length of the bristles with respect to the head is at least equal to the average maximum height of the teeth.

* * * * *